US010641567B2

(12) United States Patent
Weilharter

(10) Patent No.: US 10,641,567 B2
(45) Date of Patent: May 5, 2020

(54) VARIABLE-LENGTH FIREARM

(71) Applicant: Rene Weilharter, Ybbs an der Donau (AT)

(72) Inventor: Rene Weilharter, Ybbs an der Donau (AT)

( * ) Notice: Subject to any disclaimer, the term of this patent is extended or adjusted under 35 U.S.C. 154(b) by 0 days.

(21) Appl. No.: 16/078,033

(22) PCT Filed: Mar. 15, 2017

(86) PCT No.: PCT/EP2017/056072
§ 371 (c)(1),
(2) Date: Aug. 21, 2018

(87) PCT Pub. No.: WO2017/157988
PCT Pub. Date: Sep. 21, 2017

(65) Prior Publication Data

US 2019/0041148 A1 Feb. 7, 2019

(30) Foreign Application Priority Data

Mar. 15, 2016 (AT) ..... A 50217/2016

(51) Int. Cl.
*F41A 11/04* (2006.01)
*E05D 7/12* (2006.01)
(Continued)

(52) U.S. Cl.
CPC ..... *F41A 11/04* (2013.01); *E05D 7/12* (2013.01); *F41A 21/08* (2013.01); *F41C 23/04* (2013.01); *E05D 2007/0476* (2013.01); *E05D 2007/126* (2013.01); *E05D 2007/128* (2013.01); *E05Y 2600/412* (2013.01); *E05Y 2600/528* (2013.01); *E05Y 2600/53* (2013.01); *E05Y 2900/132* (2013.01)

(58) Field of Classification Search
CPC ..... F41A 11/04; F41A 21/06; F41A 21/08; F41A 21/484; F41A 19/18–22
USPC ..... 42/77; 89/126, 127, 160, 1.41
See application file for complete search history.

(56) References Cited

U.S. PATENT DOCUMENTS 1,487,801 A * 3/1924 Pedersen ..... F41A 3/60 42/77
3,123,928 A 3/1964 Lizza
(Continued)

FOREIGN PATENT DOCUMENTS

GB 2457992 B 9/2009

*Primary Examiner* — Stephen Johnson
*Assistant Examiner* — Benjamin S Gomberg
(74) *Attorney, Agent, or Firm* — Andrew Wilford

(57) ABSTRACT

The invention relates to a firearm comprising a housing (1), having a cartridge feed (2), a breechblock, an impacting unit having a trigger, optionally a magazine shaft (3) for holding a magazine (4), and a unit (5) of two barrels (6, 7) arranged one over the other. The upper barrel (6) is longer than the lower barrel (7). Guide protrusions (8) are provided on the unit (5) of the two barrels (6, 7), which guide protrusions are guided in corresponding control tracks (9, 10) in the housing (1), whereby the two barrels (6, 7) can be moved along the control tracks (9, 10) between two end positions, wherein, when each end position is reached, alternately one of the two barrels (6, 7) aligns with the cartridge feed (2) and therefore forms the active barrel, which can be locked in this position.

7 Claims, 2 Drawing Sheets

(51) Int. Cl.

| | |
|---|---|
| ***F41A 21/08*** | (2006.01) |
| ***F41C 23/04*** | (2006.01) |
| *E05D 7/04* | (2006.01) |

(56) References Cited

U.S. PATENT DOCUMENTS

| | | | | | |
|---|---|---|---|---|---|
| 3,392,470 | A * | 7/1968 | Kavanagh | F41A 15/00 | 42/10 |
| 3,636,646 | A * | 1/1972 | Drevet | F41A 3/58 | 42/44 |
| 3,854,231 | A * | 12/1974 | Broyles | F41A 19/62 | 42/84 |
| 4,016,800 | A | 4/1977 | Rusbach | | |
| 4,679,486 | A * | 7/1987 | Landaas | F41A 3/60 | 89/126 |
| 4,882,973 | A * | 11/1989 | Piscetta | F41A 9/35 | 89/1.41 |
| 4,967,642 | A * | 11/1990 | Mihaita | F41A 3/72 | 89/126 |
| 5,689,908 | A * | 11/1997 | Brandl | F41A 11/02 | 42/71.01 |
| 5,852,253 | A * | 12/1998 | Baricos | F41C 7/00 | 89/1.41 |
| 6,012,374 | A * | 1/2000 | Brandl | F41A 19/183 | 42/70.08 |
| 6,250,194 | B1 * | 6/2001 | Brandl | F41A 19/18 | 42/71.01 |
| 7,703,374 | B1 * | 4/2010 | Dillon | F41A 7/10 | 89/12 |
| 7,797,872 | B1 | 9/2010 | Lynch | | |
| 7,810,271 | B2 | 10/2010 | Patel | | |
| 8,584,391 | B1 | 11/2013 | Calvert | | |
| 2004/0244258 | A1 * | 12/2004 | O'Dwyer | F41A 9/35 | 42/77 |

* cited by examiner

VARIABLE-LENGTH FIREARM

CROSS REFERENCE TO RELATED APPLICATIONS

This application is the US-national stage of PCT application PCT/EP2017/056072 filed 15 Mar. 2017 and claiming the priority of Austrian patent application A50217/2016 itself filed 15 Mar. 2016.

TECHNICAL FIELD

The invention relates to a firearm comprising a frame with a cartridge feed, a breechblock, a firing mechanism having a trigger as well as an optional magazine shaft for holding a magazine, and an assembly of two barrels arranged one over the other.

PRIOR ART

The threat scenario of the Cold War, which extended into the late 1980s and early 1990s and in which armies stood opposing each other and were required to operate in troop maneuvers and trench warfare, is receding more and more in that form into the background. In today's conflicts, civil war-type scenarios and decentralized terrorist activities in urban surroundings prevail. Thus, one can assume that urban warfare will increasingly be the setting.

In this confined urban battle area, the soldiers' assault rifles, some of which were designed in the 1970s, are clearly too bulky and outdated. A soldier, who needs to fight in "close quarters" in stairwells as well as directly afterward in a row of houses at a spacing of 150 m for example should have a weapon that is adapted to conditions.

On the one hand, he will require a weapon with a long, more precise barrel to also effectively combat a target at a greater distance, and also a short weapon, as special units are known to use, to operate in confined spaces in an agile and maneuverable manner.

The prior art describes adapters that enable a pistol to be clamped in place and this weapon to be used with a shoulder stock and an extended barrel at greater distances, too. These solutions all have the disadvantage that on the one hand, additional parts separate from the weapon must be brought along; the conversion requires in most cases multiple hand movements or even the use of a tool; on the other hand, merely extending the pistol barrel with an add-on adapter is, also, associated with reduced functional reliability. These adapters are more like technical gadgets or are used only in private sport shooting, where the advantage supposedly lies in that two weapons do not have to be procured in order to be able to shoot at different ranges. For use in crisis situations, all these are unsuitable since a quick change must take place here without additional parts being brought along for the conversion.

A shotgun with a telescope-like extendable barrel is known for example from WO 2014207586 [U.S. Pat. No. 8,584,391]. This telescope-like extension is used particularly to change the scatter angle of the pellets. For long arms with rifled barrels, such a solution is however unsuitable.

U.S. Pat. No. 3,123,928 describes a weapon in which a separate barrel for cartridges and one for pellets can be folded down for transport. However, in the transport position the weapon is not usable because the two folded-down barrel sections prevent one from actuating the trigger. Furthermore, the problem here is that the separate barrels, just as in the adapter solutions, diminish the functional reliability of the weapon compared to a solution with a continuous one-piece barrel.

DESCRIPTION OF THE INVENTION

Therefore, the object of the present invention is to provide a firearm that eliminates the above-mentioned disadvantages, can be used both as a compact weapon for short distances as well as for longer ranges, and where in each operating mode, there is a one-piece continuous, active barrel. The weapon is to be thereby quickly convertible between the two operating modes without using additional add-on parts.

This object is achieved according to the invention in that the upper barrel is longer than the lower barrel, and that the assembly of the two barrels carries tabs that are guided in respective control tracks in the frame so that the two barrels can be moved along the control tracks between two end positions, and upon reaching each of end position a respective one of the two barrels aligns with the cartridge feed, thereby forms an active barrel, and can be locked in this position. The weapon according to the invention thereby combines two weapons systems, for example an assault rifle and a machine pistol, in one single lightweight portable firearm. One can switch between the two operating modes within a few seconds. The assembly of the two barrels arranged above each other is guided by control tracks in the frame and centered and locked in the end positions. The locking can be released again by a push button or lever and the barrel assembly can be quickly switched into the other operating mode. The average person skilled in the art understands that depending on the weapon design, the control tracks can be on the barrel assembly and the guide tabs can also be in the frame.

According to another feature of the invention, it is provided that both barrels are of the same caliber. In principle, this weapon can also be used to quickly change two barrels having different calibers. However, it is preferred that both barrels have the same caliber so that no magazine change or any other modifications are necessary, and only the operating parameter of the weapon is quickly modifiable.

Another feature of the invention is that the two essentially identical control tracks are on both sides of the assembly of two barrels in the frame, and each barrel has on both sides at least in each case a respective a guide tab for the respective control track. This represents a particularly simple and cost-effective solution that allows a high level of functional reliability and exact guiding of the barrel assembly.

A further feature of the present invention is that each control track has two end sections extending from the lower and upper end positions respectively essentially parallel to the barrels, and a center section extending at an angle to the barrels, connecting the two end sections to each other, and serving to vertically displace the two barrels. When switching between the two operating modes, the user, after unlocking the currently active barrel, then first pulls the barrel assembly from the frame forward toward the barrel so that the guide tabs move along the respective end sections of the control track. Then the barrel assembly is moved vertically by moving the control tracks along the center sections, either downward when switching from a short-barrel to a long-barrel weapon, or upward when switching over from a long-barrel to a short-barrel weapon. Last, the barrel assembly is pulled back along the respective second end section toward the frame and the active barrel is thereby locked once again to the frame.

Another feature of the present invention thereby is that the assembly of the two barrels one above the other is biased by at least one spring connected to the frame toward an end position, preferably toward the end position in which the short barrel aligns with the cartridge feed. Depending on the construction-type of the weapon, it may be a tension or pressure spring, or multiple springs. Also depending on the application, the switchover can thereby take place automatically by the pretension toward the one or other end position, in other words toward the long-barrel weapon or toward the short-barrel weapon. Preferably, a switchover from a long-barrel to a short-barrel weapon is thus possible in a particularly rapid manner. If the weapon just happens to be using the long barrel as the active barrel, only releasing the locking mechanism is necessary and due to the spring, the barrel assembly springs back into the end position with the active short barrel and locks. In this way, the weapon can be made operationally ready for close-quarters combat very quickly with a single hand movement.

Last, it is a feature of the invention that an extractable shaft with a shoulder stock is provided in the frame. In order to further increase the target accuracy and comfort in the operating mode with a long barrel in an active end position, an extractable shaft with a shoulder stock may be provided in the frame.

BRIEF DESCRIPTION OF THE DRAWINGS

The invention is described in greater detail with reference to of the attached drawings, where.

EMBODIMENTS OF THE INVENTION

Figure 1:
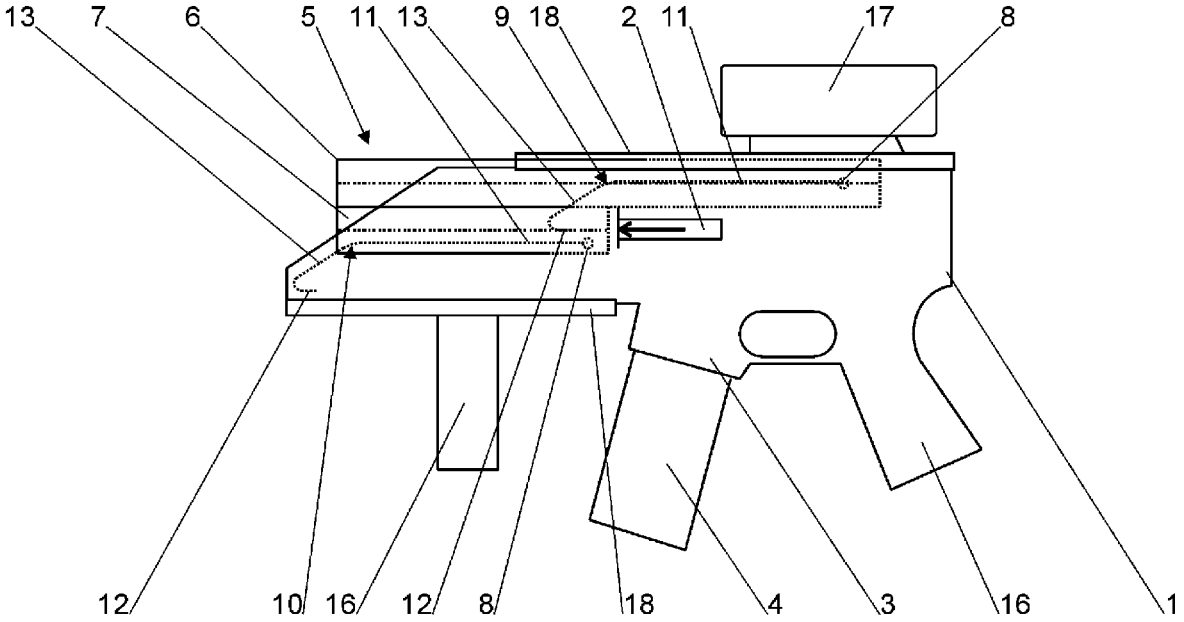
FIG. 1 is a schematic view of a weapon according to the invention in an end position with an active short barrel.

The firearm according to the invention shown in FIG. 1 has a frame 1 carrying a cartridge feed 2, a firing mechanism, a breechblock and a trigger (not shown). Furthermore, the frame 1 has a magazine shaft 3 for receiving a magazine 4 as well as grips 16. Optionally, as shown in the illustrated embodiment, other add-on parts may be provided on the frame, such as sights 17 or attachment rails 18, for example a Weaver rail.

Furthermore, in the frame there are upper control tracks 9 and lower control tracks 10 in which guide tabs 8 of an assembly 5 of two barrels 6, 7 arranged above each other are guided. The guide tab of the upper barrel 6 is thereby guided into the upper control tracks 9 and those of the lower barrel 7 in the lower control track 10.

The control tracks 9, 10 are each essentially constructed in the same manner. Each control track has an upper end section 11 and a lower end section 12 that extend essentially parallel to the barrels 6, 7. These two end sections 11, 12 are each connected by a center section 13 that extends diagonally to the two end sections 11, 12 and connects them to each other.

FIG. 1 shows the firearm in an end position in which the shorter lower barrel 7 is aligned with the cartridge feed 2 and is locked as the active barrel. The longer upper barrel 6 is accommodated in a space-saving manner in the frame 1 so that the weapon is not longer than a conventional small arms weapon with a short barrel. Therefore, the weapon can be easily used in close-quarter combat situations. Another advantage is that the structural overall length of the weapon is significantly shortened, to some extent even by more than half, in comparison to conventional long-barrel weapons, which also simplifies transportation and storage of the weapon.

Figure 3:
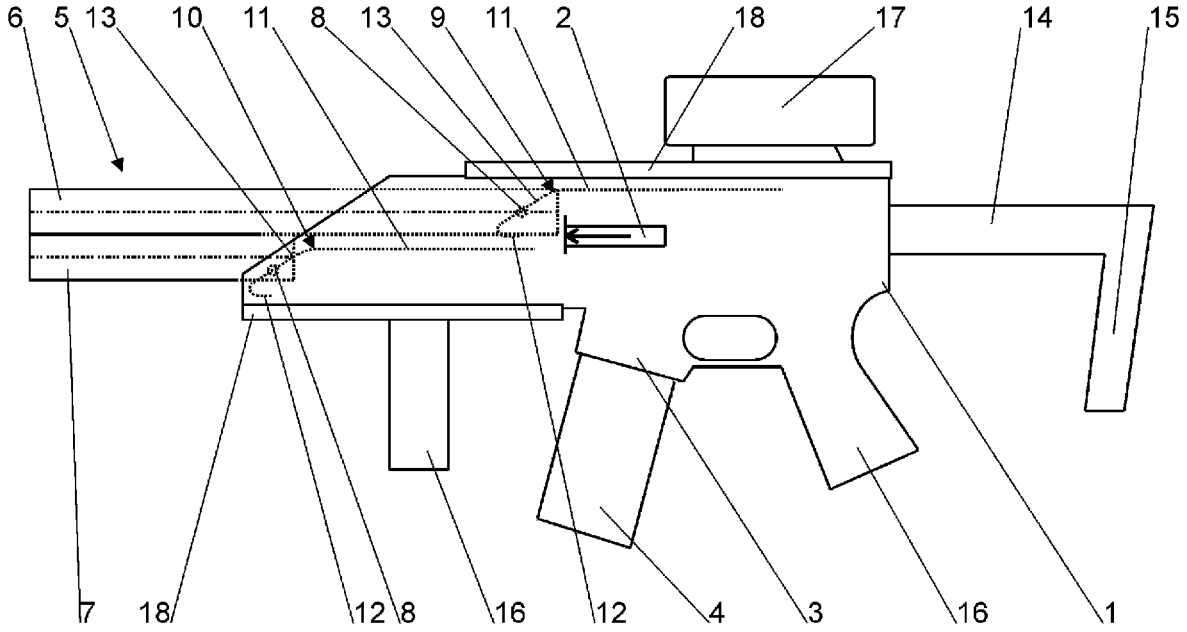

If one now wishes to switch the weapon over for long-range use, the barrel assembly 5 is unlocked and initially pushed forward parallel to the barrels 6, 7 away from the frame so that the guide tabs 8 slide along the upper end sections 11 of the respective control tracks 9, 10. On reaching the center section 13 of control tracks 9, 10, the assembly 5 of both barrels 6, 7 is displaced downward, and the long upper barrel 6 is pushed in front of the cartridge feed 2. This intermediate position during the shifting is shown in FIGS. 3.

Figure 2:
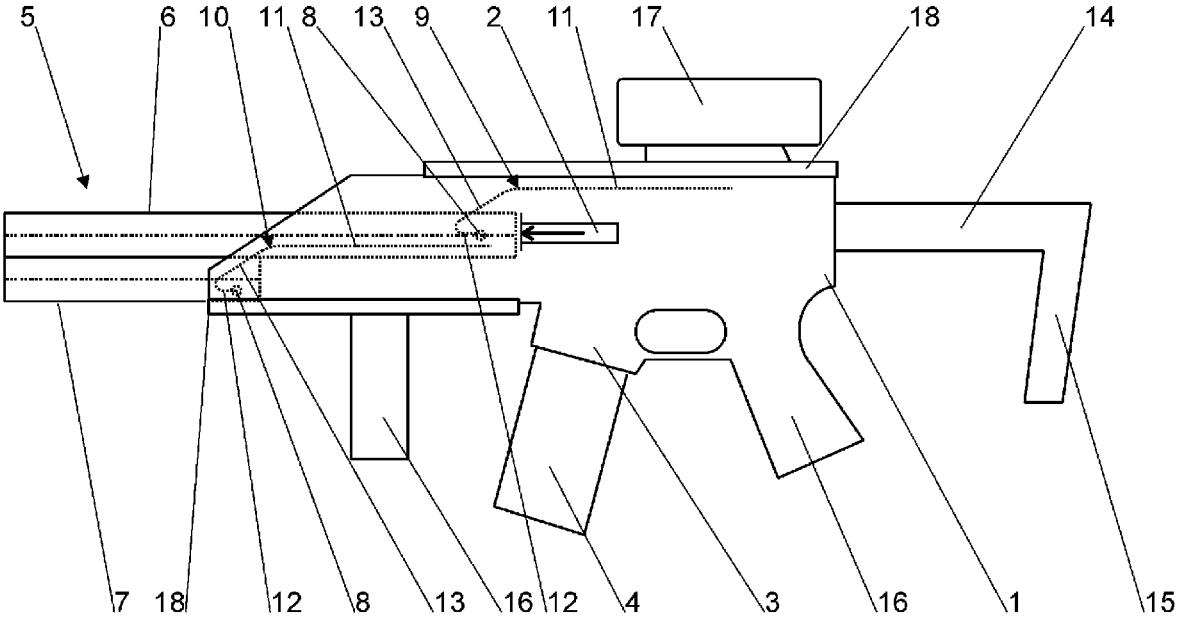
FIG. 2 shows a weapon according to the invention from FIG. 1 in the other end position with an active long barrel and FIG. 3 shows the weapon according to the invention from FIG. 1 in an intermediate position when switching between the two end positions.

The barrel assembly 5 is then pushed back along the lower end section 12 toward the frame 1 and the now active long barrel 6, which is now aligned with cartridge feed 2, locks as is shown in FIG. 2. In addition, a shaft 14 with a shoulder stock 15 accommodated in the frame 1 can be pulled out for long-range use of the weapon.

The invention claimed is:

1. A firearm comprising:

a frame having a cartridge feed;

an assembly consisting of an upper long barrel and a lower short barrel, the short barrel being shorter than the long barrel;

control tracks on the frame; and respective guide tabs guided in the control tracks for movement of the barrels along the control tracks between upper and lower end positions in each of which a respective one of the barrels is aligned with the cartridge feed, sets one of the barrels as an active barrel, and can be locked in position.

2. The firearm according to claim 1, wherein the barrels are of the same caliber.

3. The firearm according to claim 1, wherein there are two of the control tracks that are essentially identical, a respective one of the control tracks being provided on each side of the assembly on the frame, each of the barrels having at least one of the guide tabs engaged with a respective one of the control tracks.

4. The firearm according to claim 1, wherein each of the control tracks has respective front and rear end sections that extend from the lower and the upper end positions toward each other parallel to the barrels and a center section extending at an angle to the barrels and connecting the respective end sections to each other and serving to vertically displace the barrels between the end positions.

5. The firearm according to claim 1, further comprising:

a spring biasing the assembly with one of the barrels over the other of the barrels toward the end position in which the lower short barrel is aligned with the cartridge feed.

6. The firearm according to claim 1, further comprising:

an extractable shaft with a shoulder stock in the frame.

7. A firearm comprising:

a frame having opposite side faces each formed with a respective guide track having a pair of parallel but vertically spaced front and rear end sections and an angled center section extending between inner ends of the respective end sections;

a cartridge feed in the frame;

a barrel assembly having an upper long barrel extending parallel to the end sections and a lower short barrel fixed and parallel to the upper long barrel; and respective guides on the barrel assembly engaged in the tracks and movable therealong between an upper rear position with the short barrel aligned and cooperating with the cartridge feed and a lower front position with the long barrel aligned and cooperating with the cartridge feed, whereby in the upper rear position the short barrel is active and in the lower front position the long barrel is active.

* * * * *